US006637143B1

(12) United States Patent
Wykle

(10) Patent No.: US 6,637,143 B1
(45) Date of Patent: Oct. 28, 2003

(54) QUICK LOADING MUZZLELOADER SYSTEM

(76) Inventor: Richard Shawn Wykle, HC 37 Box 109, Frankford, WV (US) 24938

( * ) Notice: Subject to any disclaimer, the term of this patent is extended or adjusted under 35 U.S.C. 154(b) by 0 days.

(21) Appl. No.: 10/087,310

(22) Filed: Feb. 28, 2002

(51) Int. Cl.[7] ..... F41C 27/00
(52) U.S. Cl. ..... 42/90; 224/150
(58) Field of Search ..... 42/90; 224/150

(56) References Cited

U.S. PATENT DOCUMENTS

| | | | | | |
|---|---|---|---|---|---|
| 163,404 | A | * | 5/1875 | Phillips | 224/149 |
| 2,508,820 | A | * | 5/1950 | Fraley | 224/18 |
| 3,757,449 | A | * | 9/1973 | Schindler | 42/87 |
| 3,869,074 | A | * | 3/1975 | Roach | 224/149 |
| 4,050,175 | A | * | 9/1977 | Mulinix | 42/90 |
| 4,152,858 | A | | 5/1979 | Dobbs | 42/90 |
| 4,414,770 | A | * | 11/1983 | Brinton, Sr. | 42/90 |
| 4,442,620 | A | | 4/1984 | Drake et al. | 42/90 |
| 4,466,209 | A | * | 8/1984 | Strickland et al. | 42/90 |
| 4,533,019 | A | * | 8/1985 | Leding | 184/14 |
| 4,550,517 | A | | 11/1985 | Mansfield | 42/90 |
| 4,589,220 | A | * | 5/1986 | Lofland | 42/90 |
| 4,607,446 | A | * | 8/1986 | Scheuring | 42/90 |
| 5,016,380 | A | * | 5/1991 | Jones | 42/90 |
| 5,081,781 | A | * | 1/1992 | Kanyuck et al. | 42/90 |
| 5,092,072 | A | * | 3/1992 | Fritts | 42/90 |
| 5,109,623 | A | * | 5/1992 | French | 42/90 |
| 5,182,412 | A | | 1/1993 | Mazza | 42/90 |
| 5,375,358 | A | | 12/1994 | Riness et al. | 42/27 |
| 5,692,654 | A | * | 12/1997 | Bell | 224/150 |
| 6,119,907 | A | * | 9/2000 | Benjamin | 224/150 |
| 6,152,338 | A | * | 11/2000 | Smith | 224/149 |
| 6,367,186 | B1 | * | 4/2002 | Gibala | 42/51 |

* cited by examiner

*Primary Examiner*—Michael J. Carone
*Assistant Examiner*—Denise J Buckley
(74) *Attorney, Agent, or Firm*—Richard C. Litman

(57) ABSTRACT

A device for the accelerated loading of muzzle loading firearms comprising a hollow cylindrical magazine (10), with a number of vertical through tubes (12) equally spaced around the perimeter. The through tubes (12) are consistent with the bullet (58) size being used. Each through tube (12) contains threads (16) protruding from the top of the magazine (10). This allows penetrable color-coded discs (52) to be placed thereon, and held securely by hollow center nuts (20). The bottom "muzzle mating" tapered ends (24) have cap sealing ribs (28) which hold the powder sealing caps firmly in place. A center tube (56) passes through the magazine (10) expanding in size and extending from the bottom. Creating a barrel holding center handle (38), which houses the compression spring (76) system, which receives the quick detachable T handle (34) and starting rod (42). The device is carried by a sling (64) containing two plunger (68) type dispensers. One for the 209 Primers (70), the other for Percussion Caps (74).

14 Claims, 8 Drawing Sheets

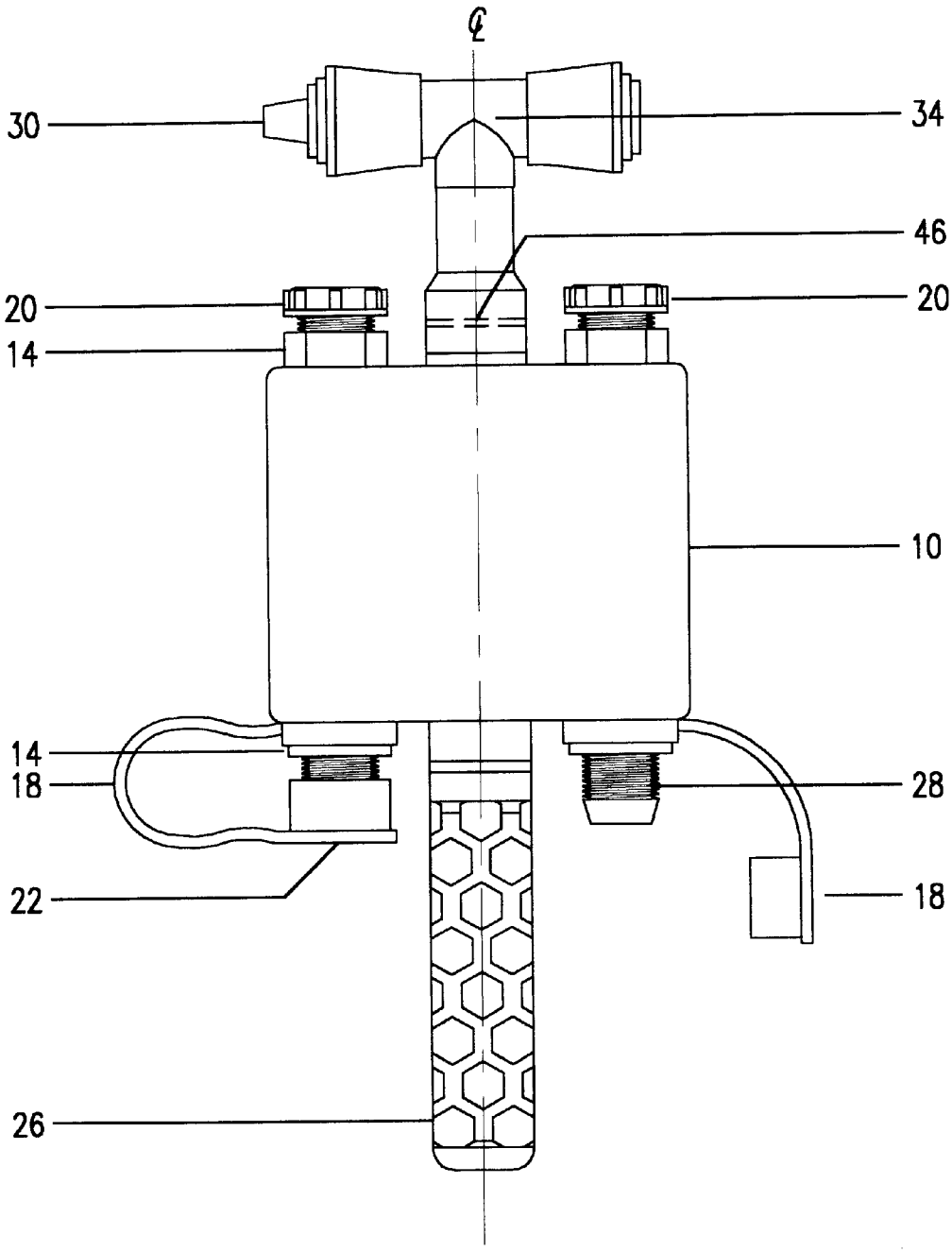
FIG 1-A

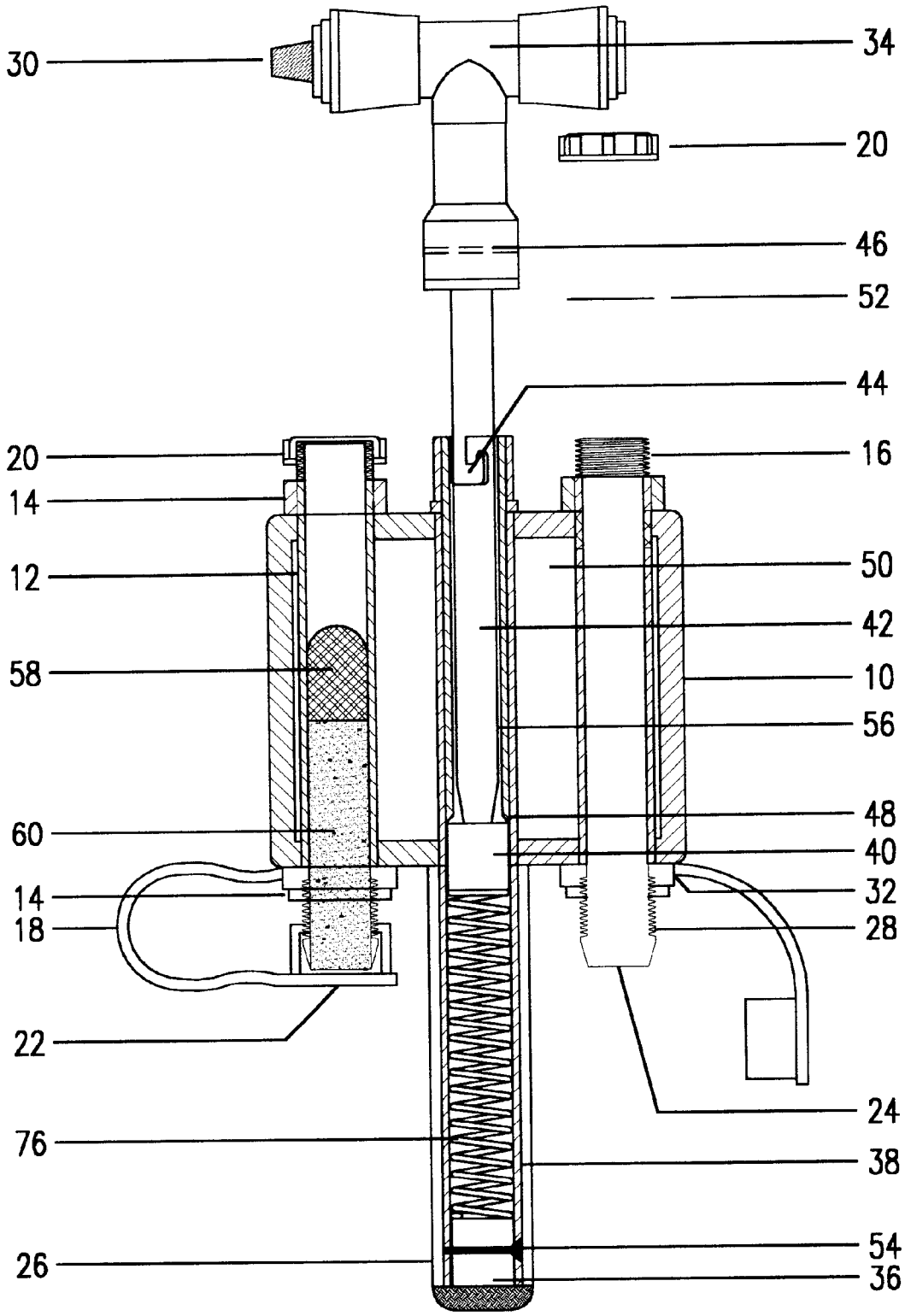
FIG 1-B

QUICK LOADING MUZZLELOADER SYSTEM

CROSS-REFERENCE TO RELATED APPLICATIONS

Not Applicable

BACKGROUND—FIELD OF INVENTION

The discussed invention pertains to the accelerated loading of muzzle loading firearms. More particularly, the invention relates to a multiple chambered device for quickly and easily reloading a muzzle-loaded firearm a number of times.

BACKGROUND—DESCRIPTION OF PRIOR ART

There are various implements known in the prior art, which are used for the accelerated loading of muzzle loading firearms. Most of which fall into two different categories.

The first being the load carrying category, which facilitates a load carrying container, where the needed ingredients for loading the firearm is readily available, usually the powder is on one side and the projectile in the other with a petition in the middle.

The second category of loaders contain devices which carry the prepared shot ready to be transferred from the loader to the firearm. Some even in multiple forms, these loaders offer the advantage of rapid reloading a number of times in succession. Devices such as U.S. Pat. No. 5,182,412 to Mazza and U.S. Pat. No. 4,550,517 to Mansfield are typical examples of the cylindered formats devised for multiple loaders.

These loaders and others lack the means of holding both the loading device and the firearm barrel at the same time during the loading procedure. Most of the current devices such as U.S. Pat. No. 5,375,358 to Riness et al. and previously cited U.S. Pat. No. 5,182,412 to Mazza and U.S. Pat. No. 4,550,517 to Mansfield imply a countersunk hole that receives the firearm barrel to stabilize it during the loading procedure. Considering that not all firearm barrels have the same outside diameters, which could make for a loose, fit with a small diameter barrel or an overly tight forcing situation for the larger barrels. This could be a very serious safety hazard for the shooter and any accompanying bystanders, not to mention damage to the firearm if dropped, or powder spillage—which could greatly affect accuracy.

The current invention solves this problem with a center handle extending from the base to allow for the holding of both the loader, and the firearm during the loading procedure along with having tapered ends on the gun mating side of the load carrying through tubes which adapt more to the inside of the muzzle, which are all the same within their caliber. This allows for a safe and accurate powder transfer from the present invention to the barrel of the firearm.

Also no known prior art has the capability of color-coding the different prepared loads within the loader. This allows for different loads to be prepared for different situations at field, whether it may be weather related, range related, or for different size game to be taken. This is made possible with the present invention by using a punch through colored disc system that also allows for quick visual inspection as to which load or loads have been used, by the penetrated plastic disc. This system also aids in making the load transfer quicker and more easily performed. U.S. Pat. No. 4,152,858 to bobbs employs a disc design in which the disc is located on the powder or the bottom end side of the device. Where its soul purpose is to contain powder within the loader. This could possibly lead to a no fire situation if apiece of the disc broke free from the device and was to get between the powder and the ignition point where the primer or cap spark enters the firearm. This would require a timely process of removing the load from the firearm requiring special tools. With the current invention if a piece of disc broke free it would not effect the ignition nor the accuracy, because it would be blown out of the barrel similar to that of a shotgun wad, since it is located in front of the projectile not between the powder and the ignition source.

Another topic of interest with muzzle loading devices is the way in which they make the cap or primer readily available to the shooter. Some of which use systems like U.S. Pat. No. 4,442,620 to brake et al. Which put the cap or primer within easy reach but highly susceptible to moisture and other elements such as dirt and corrosion. Others use a capping device that puts the cap or primer directly on the nipple or breach of the firearm. These types are handy but they too are susceptible to moisture along with locating them on your person to make them within easy access when needed because for the most part these are not connected to the loading device in any way. The present discussed invention overcomes these previous problems by having a water resistant plunger type device with a pliable rubber tip that is only opened when the cap or primer is pushed through it, then being of a pliable nature it closes back allowing for a water resistant cap or primer dispenser readily located on the strap of the device.

Finally of interest simplicity of design, the current invention is designed to be light, easy to use, reliable, and fairly easy and inexpensive to manufacture unlike some of the comparable prior art such as previously mentioned U.S. Pat. No. 5,182,412 to Mazza, U.S. Pat. No. 4,550,517 to Mansfield, and U.S. Pat. No. 5,375,358 to Riness et al. These all have a rotating system, which after time and normal wear between the surfaces and parts could allow powder to leak between the rotateable surface while in use, which would affect the accuracy and speed in loading. That would be a warranty issue for the manufacturer and a loss in profitability not to mention a disappointment to the owner. This is yet another way the present invention sets its self apart, simplicity and reliability means profitability for the manufacturer and satisfaction for the user or customer.

SUMMARY

The present invention is related generally to muzzle loaded guns. More specifically, the invention is the quick loading muzzleloader system.

The muzzleloader system comprises a cylindered magazine with a number of through-holes formed of plastic. The holes are equally spaced around the perimeter of the cylindered magazine. The holes comprise hollow tubes that are consistent with the bullet size being used. The tubes are connected at both ends of the cylindrical magazine. The ends of the tubes connected at the top of the cylindrical magazine have threads, which allow for hollow center nuts to be placed there on. The hollow center nuts allow a plastic disc of different or the same colors to be placed over the hole and then held in place as the nut is tightened over it. This forms a water resistant seal and allows the tapered end of the starting rod to easily punch through into the tube. The bottom ends of the tubes have cap-sealing ribs tapered at the ends, to fit the end of the muzzleloader barrel. This prevents the powder from spilling during loading. The cap-sealing ribs allow for a good seal when the powder sealing caps are in place. The powder sealing caps are made of a pliable rubber and each cap has a tether that connects the cap to the cylindrical magazine. Another tube passes through the center of the cylindrical magazine. The central tube has a push-and-turn lock on top. The central tube extends past the bottom of the cylindrical magazine and has a handle that allows the user to hold the loader and the firearm barrel at one time while pushing the prepared load into the barrel. The handle has a plug at the bottom covered by a rubber grip. A compression spring is positioned inside the handle on top of the plug. A sliding plug is positioned on top of the spring. The top plug is stopped by a decrease in the diameter of the central tube. The handle is the larger end and the top is the smaller end. This allows the starting rod to be held in place and easily accessible once it is pushed down and turned. The rod has a T handle and a starting knob. The rod and the starting knob may be made of wood, preferably oak, or hard plastic. A sling is connected to the cylindrical magazine by a swivel. The sling includes two slots. One of these is for a #209 Primer dispenser and the other for a Percussion Cap dispenser. The primer and the cap dispensers are plunger-type containers having a rubber tip with a + cut in the end.

OBJECTS AND ADVANTAGES

Accordingly, besides the objects and advantages of the Quick Loading Muzzleloader System described above. Several objects and advantages of the present invention are:

a) to provide a one cap and tap design. Pull one bottom or powder side cap, invert, penetrate disc and tap into the barrel. Finishing tamping with the muzzleloader rod and then cap or prime. You are then ready for the shot;

b) to provide more ease and comfort in loading. The quick detach T handle priming rod, which works for transferring the load from the device to the muzzle of the gun. Also the device can be used for pushing the load further down the barrel of the firearm;

c) to provide a light easy to carry model using the hollow cylinder construction with rigid through tubes connected on either side;

d) to provide more accurate powder transfer, by using tapered ends on the bottom or powder sides which taper directly into the bore to assure none is left lying on the barrel end or on the ground;

e) to provide a quick visual inspection as to which pre-loaded shot has been used. In the case of a multiple shot situation using the punch through disc design;

f) to provide a safe loading device by using the bottom center extended handle that allows the shooter to hold both the gun and the loader with one hand. This insures one hand never leaves the firearm;

g) to provide an easily accessed water resistant cap or primer dispenser located conveniently on the carrying sling;

h) to provide a system, which allows the shooter to load different types of loads. Whether it is a powder charge difference, a bullet, or projectile difference. The plastic disc can be color coded accordingly to distinguish between the loads;

i) to provide a clean dry mating surface. Pull off caps are used on the bottom of the powder side that cover and seal the moisture, dirt, and debris from the entire mating surface and they are securely connected by tether's to ensure they are not lost.

Further objects and advantages are to provide a complete muzzle loading system. Everything needed to shoot a muzzle-loading firearm a number of times on one light, strong, and easy to use device. All that is needed is a good shooting firearm. Still further objects and advantages will become apparent from a consideration of the ensuring description and drawings.

DRAWING FIGURES

In the drawings, closely related figures have the same number, but different alphabetical suffixes.

FIG. 1A shows a side view of the exterior components and cylindrical magazine of the Quick Loading Muzzleloader System.

FIG. 1B shows a side internal view of the Quick Loading Muzzleloader System and the parts contained within the cylindrical magazine.

REFERENCE NUMERALS IN DRAWINGS

| | |
|---|---|
| 10 cylindrical hollow magazine | 12 through tube |
| 14 through tube connection point | 16 threaded end |
| 18 tether | 20 hollow center nut |
| 22 powder sealing cap | 24 tapered ends |
| 26 grip | 28 cap-sealing ribs |
| 30 starting knob | 32 tether connecting ring |
| 34 T handle | 36 fixed plug |
| 38 center handle | 40 siding plug |
| 42 starting rod | 44 quick detach locking notch |
| 46 quick detach locking pin | 48 reduction point |
| 50 hollow space | 52 penetrable color-coded discs |
| 54 fixed plug retaining screw | 56 center tube |
| 58 bullet or projectile | 60 powder charge |
| 62 sling swivel | 64 sling |
| 66 cap dispenser main tubular body | 68 cap dispenser plunger |
| 70 #209 Primer | 72 pliable rubber tip |
| 74 Percussion Cap | 76 spring |

DESCRIPTION OF THE PREFERRED EMBODIMENT

Figure 2:
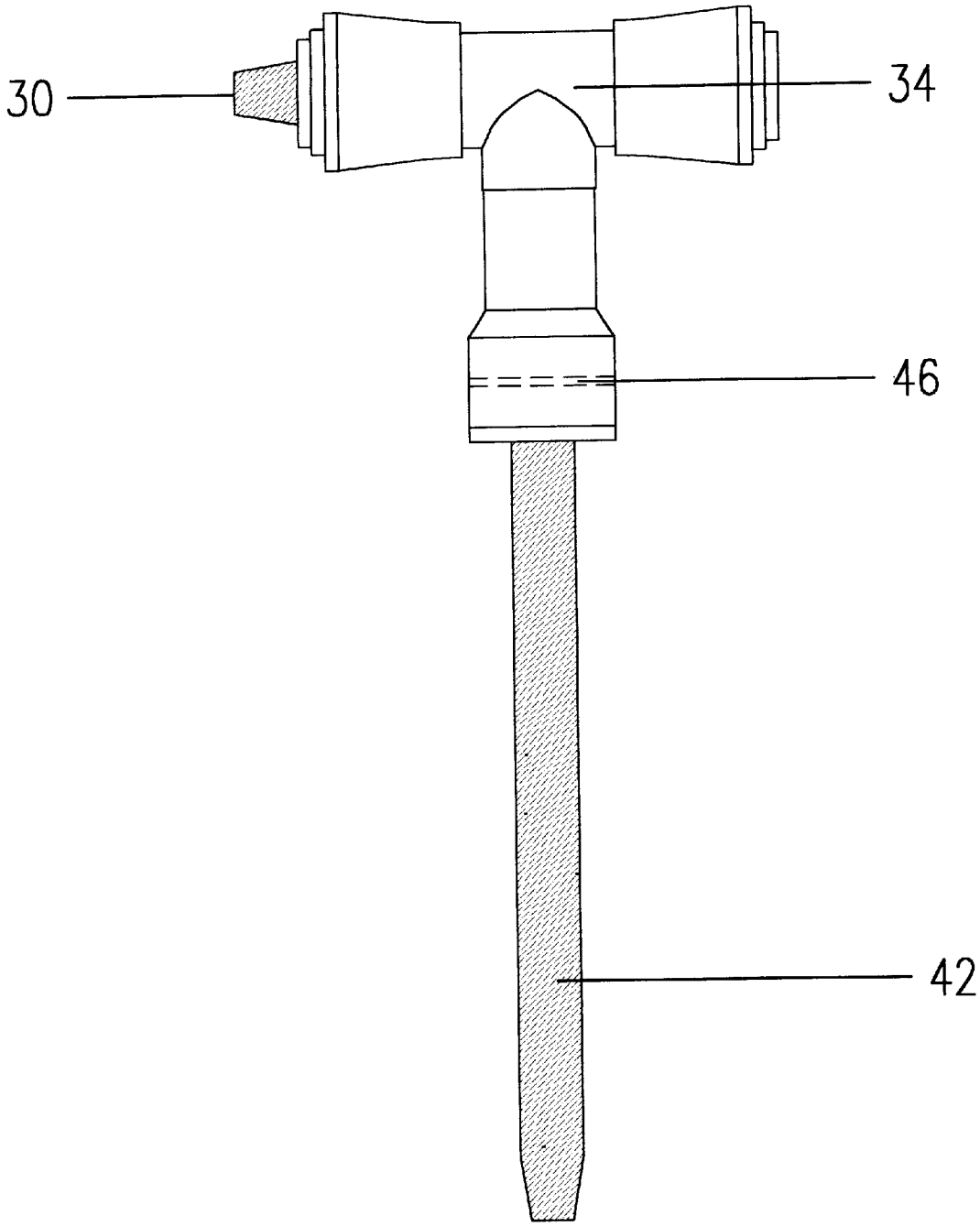
FIG. 2 shows a side view of the Quick detach T handle starting rod and knob.
Figure 3:
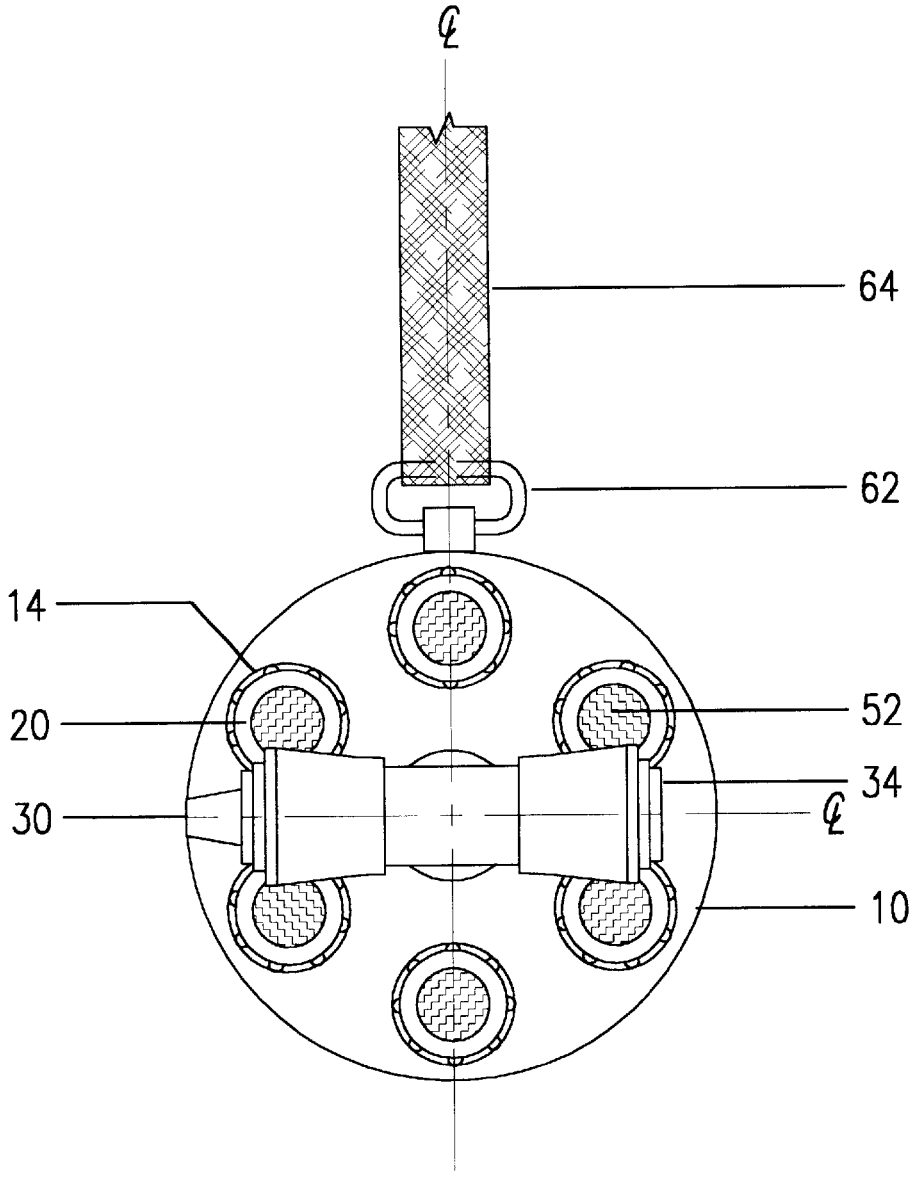
FIG. 3 shows a top plain view of the Quick Loading Muzzleloader System and sling.
Figure 4:
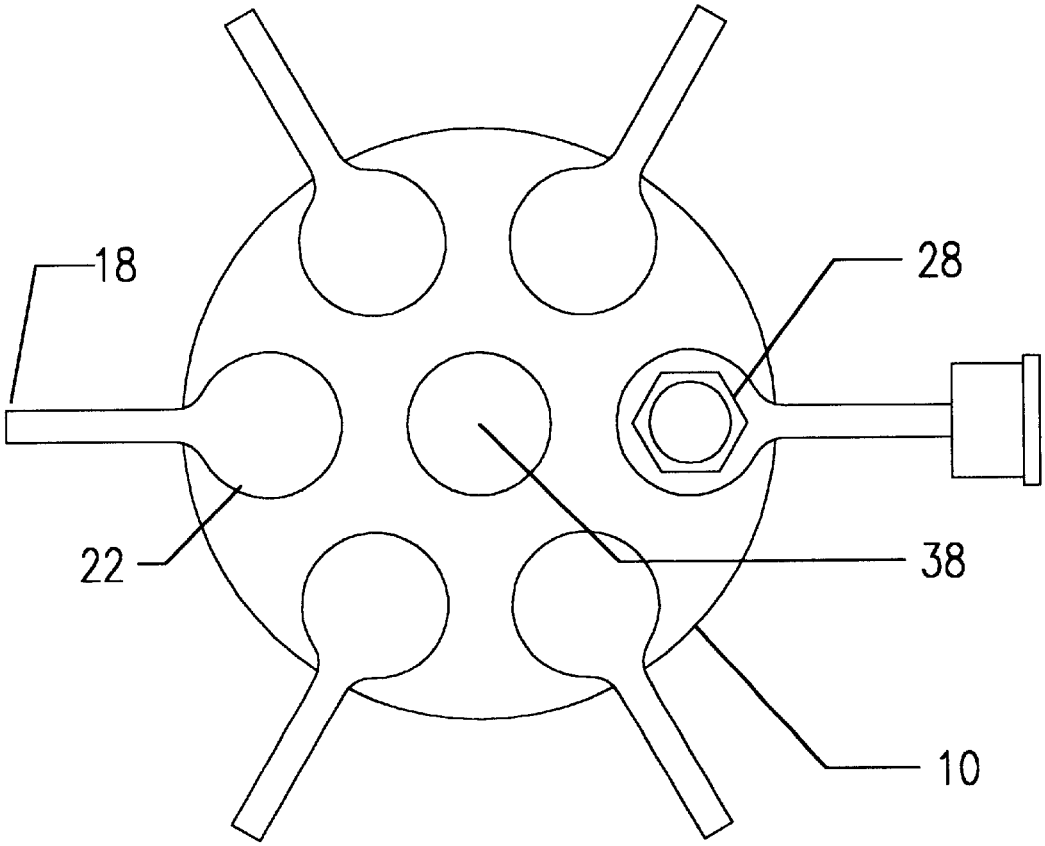
FIG. 4 shows a bottom view of the Quick Loading Muzzleloader System with one powder-sealing cap removed.
Figure 5:
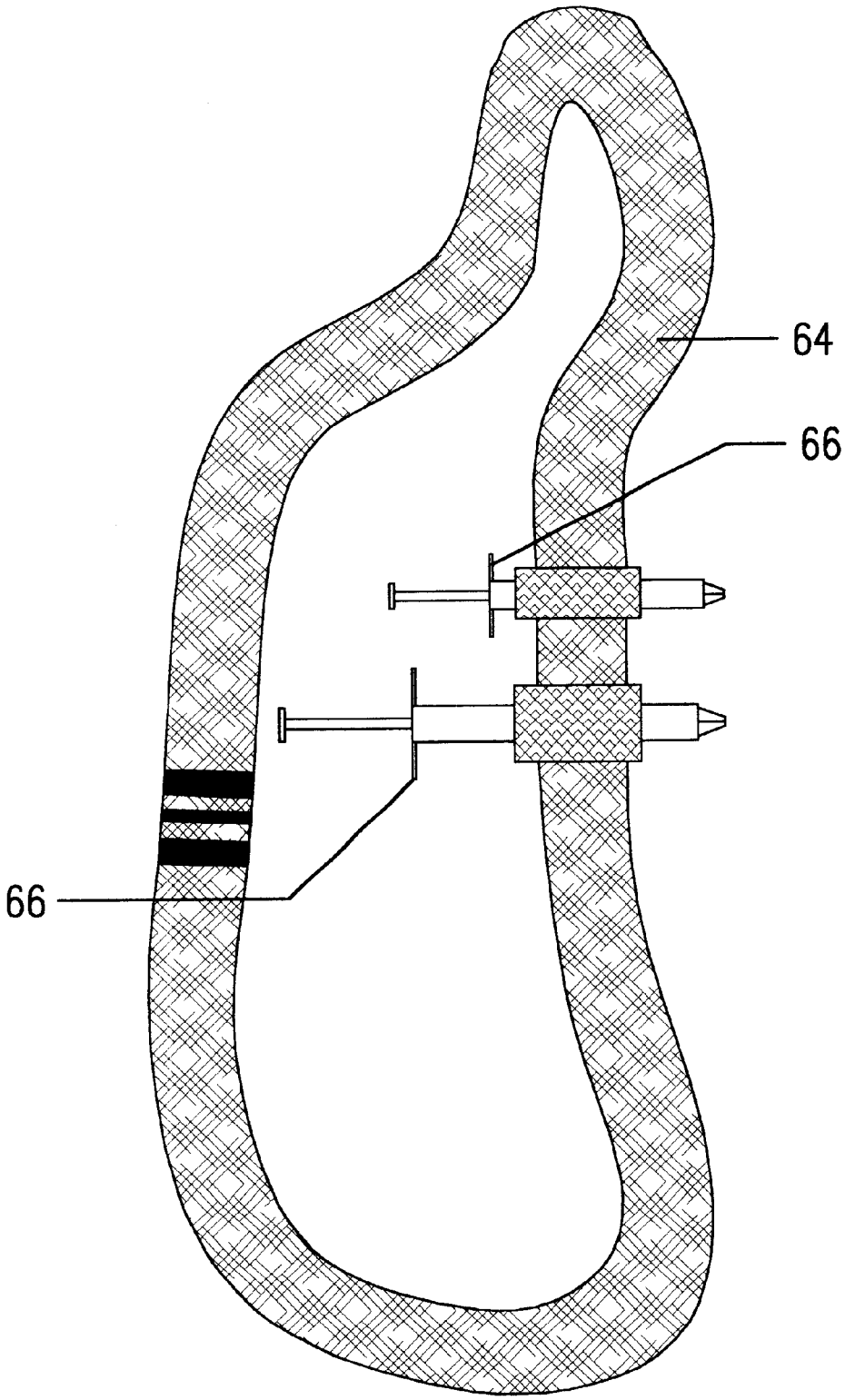
FIG. 5 shows the sling removed from the Quick Loading Muzzleloader System and the cap dispenser's contained thereon.
Figure 6:
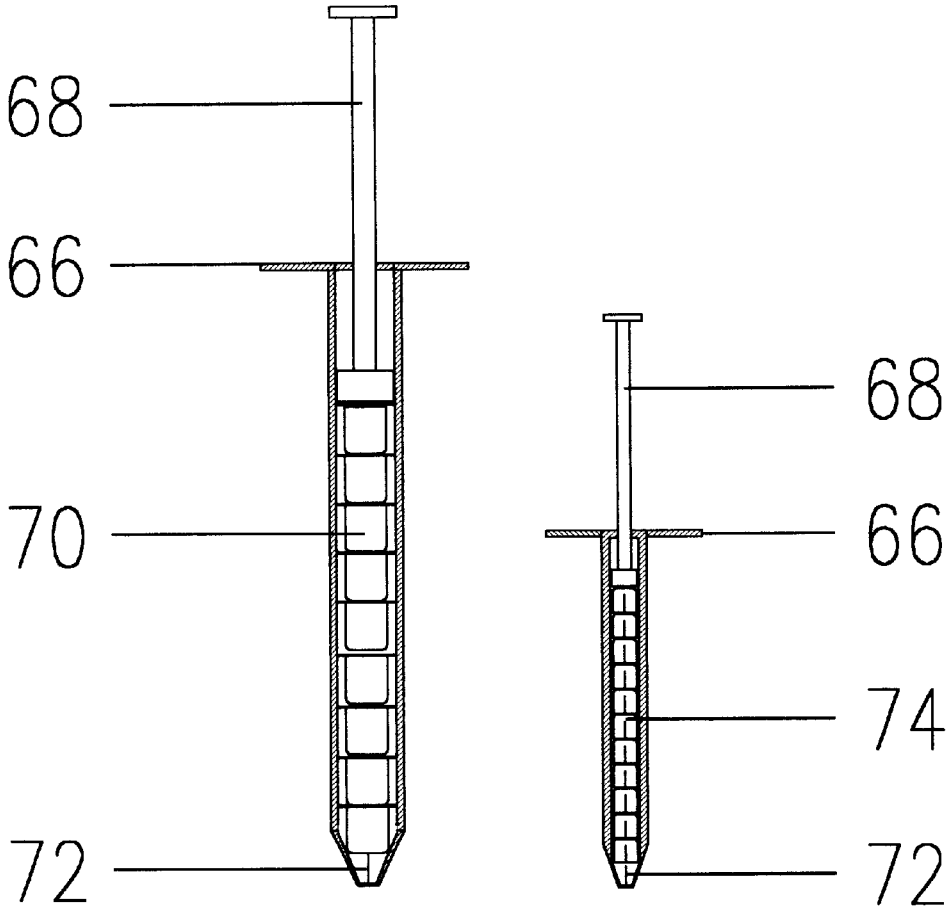
FIG. 6 shows a side internal view of both the larger #209 Primer dispenser and the smaller Percussion Cap dispenser.
Figure 7:
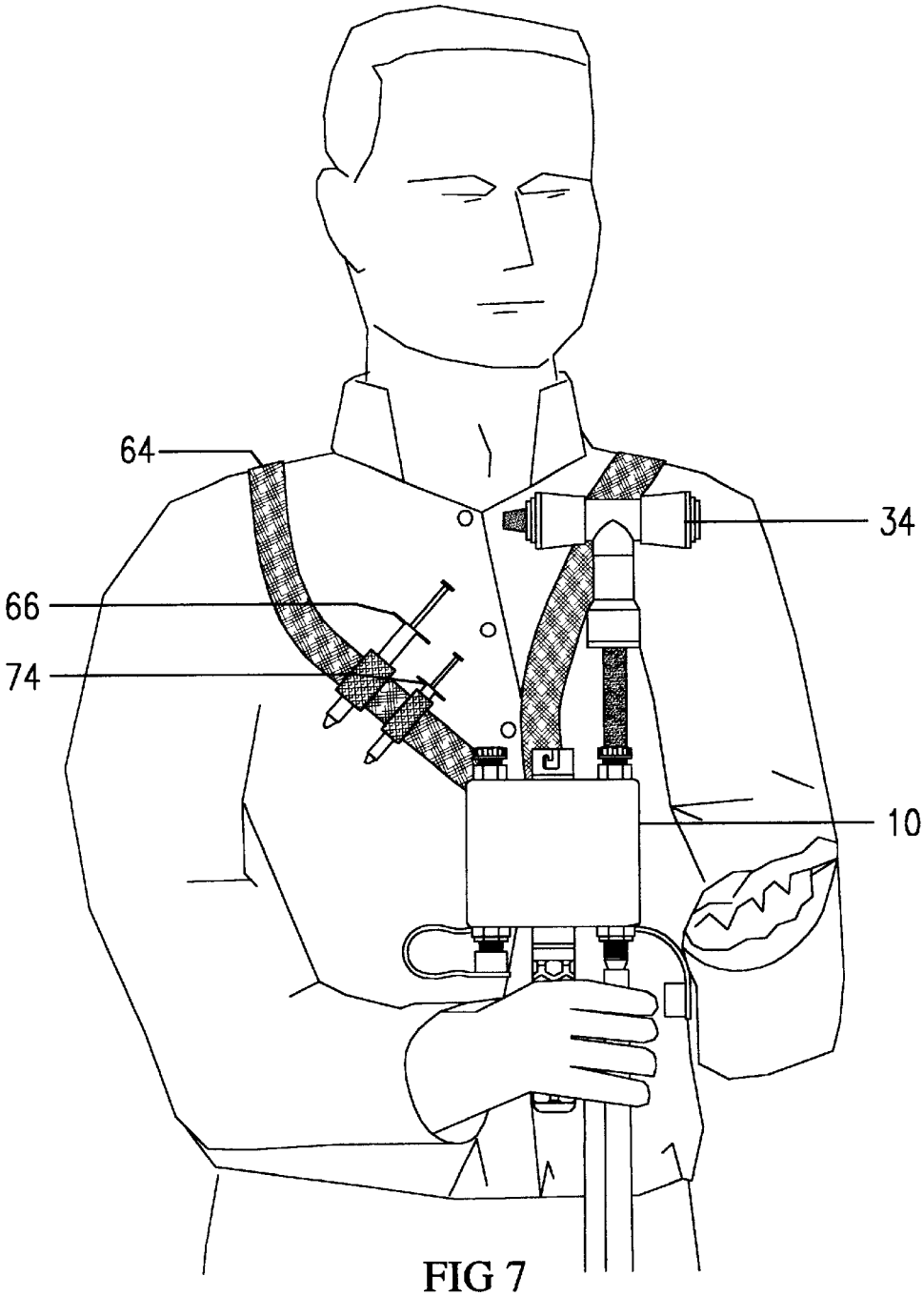
FIG. 7 shows how the Quick Loading Muzzleloader System might look in operation.

Referring more specifically to the drawings. FIGS. 1A, 1B shows the Quick Loading Muzzleloader System in the preferred embodiment comprising a cylindrical hollow magazine 10 which could be formed of many different types of rigid materials. Such as metal, aluminum, or plastics preferred embodiment uses a lightweight plastic material. Equally spaced around the perimeter of the cylindrical hollow base 10 are six through tubes 12 formed of the same material as the cylindrical magazine 10 and consistently sized for the caliber being used. These through tubes 12 are connected at either end of the cylindrical hollow magazine 10 by way of plastic through tube connection points 14 protruding above the connection points 14 on the top end of the cylindrical hollow magazine 10. The through tubes 12 contain threads 16 to receive hollow center nuts 20, which are also made of plastic. The hollow center nuts 20 allow a penetrable color-coded disc 52 to be placed over the through tubes 12 and then held in place as the hollow center nuts 20 are tightened over them. This forms a water-resistant seal and also creates a tight penetration point for the tapered end of the starting rod 42 to easily punch through into the through tubes 12. The bottom ends of the through tubes 12 have cap-sealing ribs 28 with tapered ends 24 to fit the end of the muzzleloader barrel. The cap-sealing ribs 28 allow for a good seal when the powder sealing caps 22 are in place. The powder sealing caps 22 are made of a pliable rubber and each cap has a tether 18 that connects the powder sealing caps 22 to the cylindrical hollow magazine 10, by way of tether connecting rings 32 to ensure they are not lost. Another tube passes through the center of the cylindrical hollow magazine 10 this is the center tube 56. The center tube 56 contains a quick detach locking notch 44 on top, and extending towards the bottom to a reduction point 48 from the center handle 38. The center handle 38 and center tube 56 too are made of a rigid lightweight plastic, like the other through tubes 12 and cylindrical hollow magazine 10. The center handle 38 contains a fixed plug 36 that is made of wood or plastic, located at the bottom tip of the handle and being held in a fixed position by a retaining screw 54, which is made of metal or a similar substance. This allows for a solid seat for the compression spring 76 to rest upon, which in turn provides pressure for a sliding, plug 40 also of, wood or plastic. The sliding plug 40 is located on top of the compression spring 76, and is stopped at a reduction point 48 with a small amount of pressure left on it. This allows the starting rod 42, also made of wood or plastic to be pushed against the sliding plug 40 creating pressure for the T handle 34 which again is made of a plastic material to be pushed, turned, and locked by using the quick detach locking pin 46 made of metal or something likewise. This is contained within the base of the T handle 34 and made to lock within the quick detach locking notch 44. This holds the T handle 34 and accompanying starting knob 30 located on the side of the T handle 34 and also made of wood or plastic firmly in position while not in use. The center handle 38, fixed plug 36 and the fixed plug retaining screw 54 all are covered neatly by a grip 26, made of a rubber material which aids in holding the loader steady during the loading procedure as shown in FIG. 7. FIG. 3 shows the preferred location for a sling swivel 62 that is made of metal or a suitable rigid material. This location being the upper edge of the cylindrical hollow magazine 10 here a sling 64 is attached. The sling 64 is made of a web material and connected to the sling 64 as shown in FIG. 5 are two dispensers. FIG. 6 shows a closer view of the construction of the dispenser's both containing like parts. The larger dispenser contains #209 Primers 70. The smaller dispenser contains Percussion Caps 74. Both contain a main tubular body 66 made again of a rigid plastic material. The dispenser's main tubular body 66 houses a plunger 68 which in turn pushes the #209 Primers 70 or the Percussion Caps 74 through a pliable rubber tip 72 containing a + in the end.

ADVANTAGES

From the description above, a number of advantages of my Quick Loading Muzzleloader System become evident.

a) The unique disc design allows the shooter to color code each individual prepared shot to his/her specifications. As to prepare for any foreseen situation expected in the field that day, such as wind, range, different size game to be taken etc.

b) With the punch through disc design that is highly visible located on the top upper face of the loader, takes the wonder out of which shot has already been used during multiple shot situations that are usually stressful enough as it is.

c) The bottom center extended handle allows the user to safely hold both the loader and the firearm at the same time, also allowing for a more steady and accurate load transfer.

d) Hollow center construction with rigid through tubes makes a light yet strong loader that would be cheaper to manufacture because it uses less materials than the solid cylinder with drilled through hole counterparts which allows for better profitability for the manufacturer and a better value for the user or customer.

e) The spring loaded quick detach T-handle starting rod provides superior speed, handling, and comfort in the loading procedure. Once it pops into the palm of the shooters hand ready for use and with the starting knob on the side it makes starting hard to start bullets or projectiles in the firearm barrel easy. The T-handle also provides a way of picking the loader up from the shooters side, which means his/her hand will already be in place on the T-handle for the loading procedure.

f) The water resistant plunger style cap or primer dispenser located conveniently on the sling adds even more speed to the entire system by just having to push a cap or primer through the rubber tip which closes itself once the cap or primer has cleared the end. It also contains more than enough caps or primers in case of a no fire situation, which could be caused from a partially clogged nipple on the firearm.

g) Simple yet very effective design. Everything you need to load a muzzle-loading firearm a number of times very quickly and efficiently in one system. There are no dials to turn, no guesswork as to which load has already been used, or whether or not your firearm barrel will fit securely within a recessed or countersunk hole in the base. Just pull one bottom cap, invert, and hold both the handle and the barrel of the firearm. Detach quick attach T-handle starting rod, penetrate the highly visible color-coded disc and push load into the firearm.

OPERATION—FIGS. 1-A, 1-B, 3,4,5,6,7

The operation of the Quick Loading Muzzleloader System first consists of loading the device itself, which is usually completed before the hunt or day afield. Making sure all bottom side powder-sealing caps 22 are firmly in place over the tapered ends 24, and cap-sealing ribs 28. This will then allow pre-measured powder charges 60 to be placed in the through tubes 12 of the device from the top, then the bullets or projectiles 58 in the same fashion, only this time using the starting rod 42 to assist. As the bullets or projectiles 58 will fit snug to ensure the pre-measured powder charges 60 remain behind the bullets or projectiles 58. Once these steps are completed, it is now time to seal the top ends of the now loaded through tubes 12. Placing a color-coded penetrable disc 52 over each threaded end 16. Followed by a hollow center nut 20 that firmly holds each color-coded penetrable disc 52 in place for a good seal and a tight penetration point. Different color discs 52 should be used for signifying differences in the contained loads. Whether it may be a powder charge 60 or a bullet or projectile 58 difference. This aids in a quick visual inspection as to which load is contained in each through tube 12 within the loader. Next thing to do is to pre-load the primer or cap dispenser. The larger of the two is the #209 Primer 70 dispenser and the smaller being the Percussion Cap 74 dispenser, use which ever one the muzzle loading firearm is set up to use. This is done by simply removing the plunger 68, from the rear of the main tubular body 66 and dropping the #209 Primers 70 or the Percussion Caps 76 into the back of the main tubular body 66, in the same direction they would be placed on the breech of the firearm. Once these steps are completed the Quick Loading Muzzleloader System is ready for the hunt or day afield. Now with the loader comfortably draped over the shoulder or around the neck with the sling 64 securely attached to the loader by means of a swivel 62 and also making sure the primer or cap dispenser is located in the front or chest area. The hunter or shooter, etc is now ready for the loading procedure. Once the original loaded shot from the muzzle-loading firearm has been fired, it is now time to put the loader to use. First grasp the loader, picking it up by the side or cylindrical magazine 10 while in the same notion turning the loader over facing the bottom side. Remove one of the powder sealing caps 22 and quickly inverting mating the tapered end of the loader 24 to the muzzle of the firearm. Dropping the powder charge 60 into the barrel, now holding both the barrel of the firearm and the center handle 38 of the loader with one hand. Use the other hand to push down and turn the T handle 34 removing it from the center tube 56 then penetrate the penetrable color-coded disc 52 with the tapered end of the starting rod 42 pushing the bullet or projectile 58 into the barrel. Now remove the loader from the muzzle and use the starting rod 42 to push the bullet or projectile 58 further down the barrel of the firearm. Sometimes the bullet or projectile 58 fits very snug to the muzzle in this case use the starting knob 30 for added leverage. After the bullet or projectile 58 is successfully started in the barrel of the firearm, return the starting rod 42 to the home position in the center tube 56 locking the T handle 34 back into position by way of the locking notch 44 and the locking pin 46. Next use the tamping rod (not shown) located on the firearm to finish seating the load into the barrel. Then return it to the original position. Finally grasp the Primer 70 or Percussion Cap 74 dispenser. Push the plunger 68 to eject a primer 70 or Percussion Cap 74 through the pliable rubber tip 72 containing a + cut in the end. With a primer 70 or Percussion Cap 74 falling into the hand and the pliable rubber tip 72 closing back, place the #209 Primer 70 or Percussion Cap 74 on the breech of the firearm. This completes the loading procedure, repeat as needed. With the color-coded disc 52 being penetrated it will be easy to visually see which load has already been used, and which ones are still available for use.

CONCLUSION, RAMIFICATIONS, AND SCOPE

Accordingly, the reader will see that the Quick Loading Muzzleloader System can be used to load a muzzle-loading firearm a number of times quickly, easily, and not to be left out safely using a simple useful and very rigid design that allows the shooter to tailor load his/her loader for the day afield or at the range with the highly visible color coded punch through discs located on top. Furthermore the Quick Loading Muzzleloader System has the additional advantages in that

- it provides cost-effective design that can be mass-produced so that just about any hunter, shooter, or sportsman could afford to purchase it leaving a profit margin for the manufacturer and or seller;
- it provides a lightweight loader that reduces hunter or shooter fatigue while all day afield allowing them to be more alert for game activity etc.;
- it allows the shooter to color code each individual load if different loads are needed afield;
- it provides a safe system of transferring the prepared load from the loader to the muzzle of the firearm with the unique bottom handle insuring the shooter always has one hand on the firearm;
- it provides a very clean and accurate powder transfer by using a tapered mating end that tapers directly into the gun bore and at all times (except when in use) covered by the rubber pull off cap with a tether connected to the loader to insure it is not lost;
- it permits the shooter to easily decipher which load or loads have already been used by taking one glance at the punch through discs to see which of them have been penetrated.

Although the description above contains many specifications, these should not be constructed as limiting the scope of the invention but as merely providing illustrations of some of the presently preferred embodiments of this invention. For example, the Quick Loading Muzzleloader System can have other shapes, such as square, rectangular, etc. There can be a different number of through holes, and it can be made of different materials, etc.

Thus the scope of the invention should be determined by the appended claims and their legal equivalents, rather than by examples given.

I claim:

1. An accelerated loading device for muzzle loading firearms comprising:

- a base, having a top surface, a bottom surface and a plurality of side surfaces;
- a plurality of rigid through tubes extending between said top surface and said bottom surface, said rigid through tubes being connected at both ends, where one of said rigid through tubes comprises a centrally located through tube located in the center of said base;
- a starting rod with a detachable handle centrally located on said top surface, said starting rod extending through said centrally located through tube to a bottom handle that extends from said bottom surface;
- a swiveling sling attached to said base; and
- at least one dispenser mounted on said swiveling sling.

2. The loading device of claim 1, wherein said base is a hollow cylinder.

3. The loading device of claim 1, wherein said rigid through tubes are equally spaced around the perimeter of said base.

4. The loading device of claim 1, wherein said rigid through tubes comprise a diameter that is consistent with the size of a particular bullet that is being used with said loading device.

5. The loading device of claim 1, wherein said rigid through tubes extend through and above said top surface and receive pliable discs comprising a diameter that is slightly larger than the diameter of said rigid through tubes, wherein a plurality of hollow center connectors are placed over said pliable discs to secure said pliable discs over said rigid through tubes.

6. The loading device of claim 1, wherein said rigid through tubes extend through and beyond said bottom surface and are covered by a plurality of pliable rubber caps, wherein said rubber caps are connected to said bottom surface by a plurality of tethers.

7. The loading device of claim 1, wherein said detachable handle is connected to said top surface by a push and turn lock.

8. The loading device of claim 1, wherein said detachable handle is in the shape of a T, further comprising a starting knob protruding from a first side of said detachable handle and said starting rod extending from the bottom of said detachable handle.

9. The loading device of claim 1, wherein said centrally located through tube extends from said top surface through said loading device and extends through and beyond said bottom surface creating a bottom handle.

10. The loading device of claim 9, wherein said starting rod extends from said detachable handle through said centrally located through tube and pushes on a sliding plug which comprises a compression spring that is held in place at the bottom of said bottom handle by a fixed plug.

11. The loading device of claim 10, wherein said centrally located through tube further comprises a top portion and a bottom portion, said bottom portion having a larger diameter than said top portion creating a size reduction point between said top portion and said bottom portion of said centrally located through tube wherein said size reduction point causes said sliding plug to stop and maintain a small amount of pressure on said compression spring.

12. The loading device of claim 1, wherein said swiveling sling is attached to a top edge of said plurality of side surfaces maintaining said loading device in a ready position by retaining said top surface in a face up position.

13. The loading device of claim 1, wherein said dispensers further comprise:

a tubular body;

a plunger housed inside said tubular body;

a pliable tip with a dispensing hole cut in said pliable tip; and a dispensing material housed in said tubular body;

whereby said plunger pushes said dispensing material through said hole in said pliable tip.

14. The loading device of claim 13, wherein said dispensing material is selected from the group consisting of primers and percussion caps.

* * * * *